United States Patent [19]

Di Luzio

[11] 4,134,588

[45] Jan. 16, 1979

[54] SPRING ACTUATED BILLIARD CUE

[76] Inventor: Carl L. Di Luzio, 48 Hampden St., Indian Orchard, Mass. 01151

[21] Appl. No.: 852,098

[22] Filed: Nov. 16, 1977

[51] Int. Cl.[2] ..... A63D 15/08

[52] U.S. Cl. ..... 273/69; 124/38

[58] Field of Search ..... 273/68, 69; 124/31, 124/37, 38; 43/6

[56] References Cited

U.S. PATENT DOCUMENTS

| | | | |
|---|---|---|---|
| 673,693 | 5/1901 | Beaufils | 273/69 |
| 1,157,909 | 10/1915 | Teague | 273/69 |
| 2,462,526 | 2/1949 | McNair | 273/69 X |
| 2,964,031 | 12/1960 | Dotson | 124/38 X |
| 3,246,895 | 4/1966 | Traill | 273/69 |
| 3,348,869 | 10/1967 | Zern | 273/69 X |
| 3,348,870 | 10/1967 | Zern | 273/69 X |
| 3,447,805 | 6/1969 | Baley et al. | 273/69 |
| 3,495,826 | 2/1970 | Mizgala | 273/69 |
| 3,711,093 | 1/1973 | Evans | 273/69 |

FOREIGN PATENT DOCUMENTS

| | | | |
|---|---|---|---|
| 772222 | 8/1934 | France | 273/69 |

*Primary Examiner*—Richard J. Apley

*Attorney, Agent, or Firm*—Chapin, Neal & Dempsey

[57] ABSTRACT

A spring actuated short billiard cue stick having a plunger shaft in the bore of a handle member, the shaft being slotted longitudinally in the bore with spaced enlargements therealong, a manually releasable latch member in the form of a rod associated with the slot having a reduced stem passing transversely therethrough and fitted with an enlarged catch element receivable in any of the slot enlargements to yieldably hold the shaft in a plurality of retracted positions, the reduced stem being registrable with the bore diameter and enabling spring actuated movement of the stick shaft.

4 Claims, 4 Drawing Figures

Fig. 1.
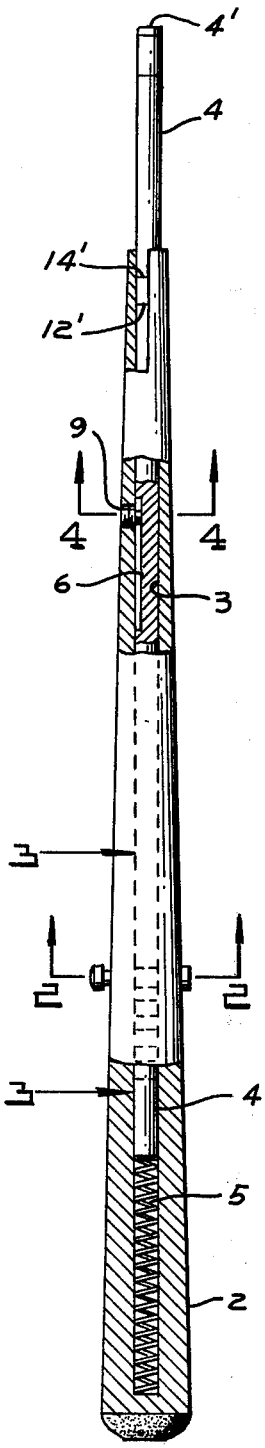
Fig. 2.
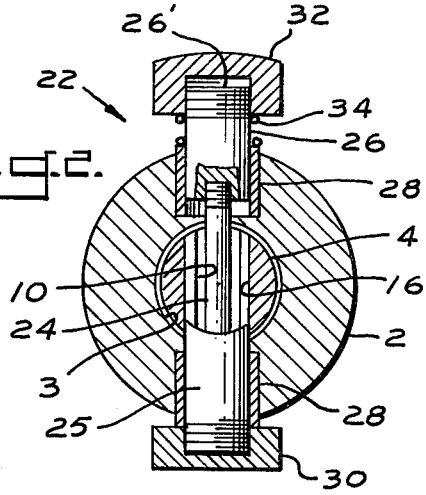
Fig. 3.
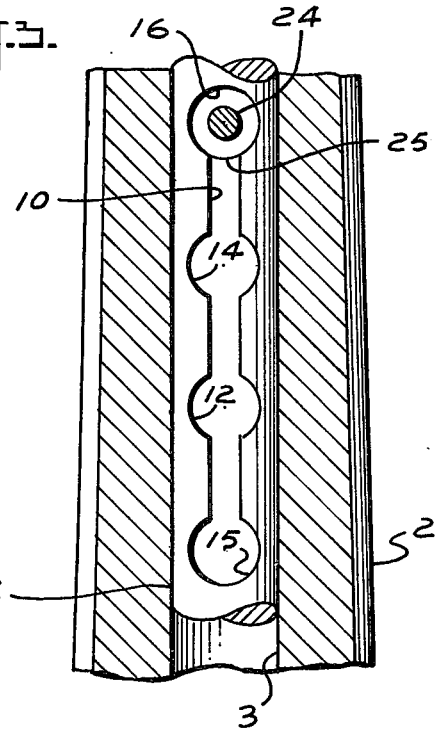
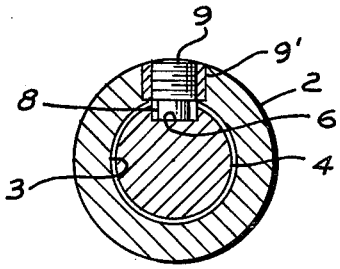
Fig. 4.

SPRING ACTUATED BILLIARD CUE

BACKGROUND

This invention relates to a billiard cue stick of a spring pressed plunger type and particularly to a simple, effective and inexpensive structure for a stick of shortened form for use in restricted quarters.

An object of the invention is to provide a shortened mechanically operated billiard cue for use on smaller size billiard tables or where a larger or regulation size table is located in a room of insufficient size or is otherwise situated so that access to the table from any angle does not permit a player unrestricted space to properly stroke the full size regulation cue stick, as for example when a back stroke of appreciable length is desirable and may be blocked by a wall surface. It is another object of the invention to provide a shortened mechanically operated billiard cue adapted to single-handed operation by a handicapped user thereof.

It is realized that heretofore various and sundry plunger type billiard cue sticks have been designed but insofar as I am aware these have been of a more or less elaborate nature. A representative example of such prior art is U.S. Pat. No. 497,929 of 1893.

Another object of the invention is to simplify the construction of such a device, the invention being in the combination of elements and arrangement of parts to provide for readily adjusting the stroke to vary the force thereof and impact on a billiard ball when the latch mechanism is triggered.

The above and other detailed objects of the invention will be apparent from the following description of the embodiment of the invention as shown by the accompanying drawings, in which FIG. 1 is a plan view of a billiard cue of this invention with parts in section; and FIGS. 2, 3 and 4 are sectional views, respectively, on lines 2—2; 3—3; and 4—4 of FIG. 1.

In FIG. 1 the handle of the shortened cue stick comprises a casing 2 of forwardly tapered construction having a longitudinal bore 3 extending therethrough. The bore is open at the fore end of the handle and the cue tip end portion of a plunger shaft or cue stick 4 projects therefrom with usual striker tip 4'. A coil spring at 5 is seated at the bottom of the bore at the rear end of the handle and bears against the inner end of the shaft. Shaft 4 is thus held under spring pressure and urged forwardly in the handle.

In the construction shown the maximum stroke of stick 4 is defined by a longitudinal recess or groove 6 cut in the side wall of the stick (see FIG. 4). Riding in groove 6 is an inner radially projecting end 8 of a plug 9 set in the handle wall. The forward and rearward limit of shaft movement is set by abutment of the end 8 of the plug against the front and rear ends of the groove. Plug 9 may be mounted in any suitable manner and is here shown by FIG. 4 as threaded in a bushing 9' set in the wall as by a press fit. As will be later described the feature of the groove and plug is a preferred construction although it is not, strictly speaking, essential for limiting movement of the shaft in operation of the device.

As will be apparent spring 5 is compressed by retraction of shaft 4 inwardly of bore 3. This may be done by manually grasping the outer end of shaft 4, holding the latch means of the device out of engagement as will be described, and telescopically pushing the shaft into the handle. Thus it will be appreciated that the billiard cue of the present invention is ideally suited for operation by a user having the function of only one hand. Alternatively, tip 4' may be set against a fixed support while the handle is pressed forwardly. The shaft may be held by latch means for release with varying degrees of sprng pressure and as shown by FIGS. 2 and 3 the simplified latch and slotted shaft construction provides for a plurality of such holding positions.

In the drawings the position of the latch and shaft for a maximum spring pressure and length of stroke is shown. In FIG. 3 the slotted shaft 4 provides for a choice of three positions by which the stroke and impact force of the cue tip may be varied in using the device. Preferably near the inner end of the shaft an elongated longitudinally extending slot 10 is cut through the shaft and provided with latch engaging enlarged sections indicated at 12, 14, and 16 for three operative positions. At the rear end of the slot an enlarged section 15 is also provided to receive the latch when the device is not being used, or, on such occasions as the user may wish to manually stroke a short stick without utilizing the spring plunger action. The enlarged sections are formed as by opposed segmental notched recesses in the walls of the slot 10 so as to receive a cylindrical catch portion 25 of the latch member, such portion 25 in FIG. 3 being shown engaged in the enlarged section 16 at the front end of the slot.

As seen in the detail of FIG. 2 the latching member, designated generally by numeral 22, is mounted for transverse shifting movement in the wall of the handle 2. A reduced stem portion at 24 intersects the bore 3, passes through slot 10 of the shaft, and has its lower end fixed to the cylindrical rod catch element 25. Catch 25 is slidably fitted in a lower opening of the handle wall to project into bore 3 and the inner end of the catch is movable to engage a notched section of slot 10 whenever the shaft is positioned to bring the notch into registration with the catch 25. At its upper end stem 24 is fitted with a cylindrical rod 26 serving as a guide and actuator member slidable in a recessed opening of the opposite upper wall section of the handle casing. The openings for catch 25 and actuator 26 are preferably fitted with bushings as indicated at 28.

The cylindrical catch 25 and actuator 26 each extend outwardly beyond the handle surface and at their ends are fitted, by the threaded connections shown, with cap members 30 and 32 respectively. Cap 30 serves as a stop piece for inward movement of the catch portion 25 and may be turned to adjust the extent to which the catch projects into the notches of slot 10. Cap 32 is in the form of a push botton or thumb actuator. A spring 34 surrounds the end of member 26 between the handle and underside of cap 32 to urge the catch 25 inwardly as in FIG. 2 for yieldably holding the catch in engaged position. It will be apparent that by depressing cap 32 against the spring 34 the catch will slide out of the notch 16 (the reduced stem portion 24 being of a length coextensive with the diameter of bore 3) and shaft 4 will thus snap forwardly in the handle by spring pressure to strike a billiard ball in using the device.

It may be noted that stem 24 is centered between the sides of slot 10 when the catch is engaged in a notch. When the catch is released, shaft 4 is thrust forwardly with sufficient in-line force to avoid undue interference by shaft 24 against the sides of the slot. Accordingly, the "tracking" guidance of shaft 4 by the end 8 of plug 9 in the recessed groove 6 of the shaft is not considered to be critical. The abutment of plug end 8 against the rear end of groove 6 at the end of a stroke will, however, center stem 24 in the rear recess 15 and thus automatically permit projection of catch portion 25 into notch 15 under the pressure of the latch spring 34. In the absence of the plug and groove abutment, stem 24 would strike the extreme rear end of slot 10 to limit the stroke. The user would then find it necessary to adjust the shaft position for engaging the catch in notch 15 or the latch spring would otherwise be left in a fully compressed condition. The abutment of the plug end 8 against the forward end of groove 6 likewise serves to automatically center stem 24 in notch 16 at the other end of the slot (as shown by FIG. 3). This eliminates any need for the player to "hunt" for centering catch 25 with the forward notch 16. As an aid to set the catch 25 for the intermediate positions in notched portions at 12 and 14, indicia marks as indicated at 12' and 14' on the fore end shaft may be provided. By registering the appropriate indicator line with the front end edge of the handle the user may be guided in centering the catch to engage the shaft as desired.

With reference to FIG. 2 and the threaded caps 30 and 32 it will be noted that the end of member 26 (as indicated at 26') is not bottomed in the threaded socket of cap 32 and that cap 30 may also be adjustably positioned at the end of catch 25. Thus the position of cap 30 can be varied to determine the extent to which catch 25 is insertable into latching position and provide for a heavy or light triggering action in using the device. Further, in using the device over an extended period the trigger action may be impaired by wear at the edges of the catch and shaft notches. In such event the cap 30 may be backed off to permit greater projection of the catch into the bore and notches and the cap 32 turned to compensate for the needed adjustment of the triggering stroke to register the reduced stem 24 with the bore.

What is claimed is:

1. In a billiard cue of the type having a handle member with a longitudinal bore, a spring in the bore, a cue stick shaft pressed forwardly by said spring with the tip end portion of the stick projecting from the front end of the handle;

the combination of a slotted shaft and a manually releasable latch construction to impart different shaft stroking forces in using the cue, comprising:

a latch member mounted for limited transverse movement in the handle wall having a reduced stem portion intersecting the bore and of a length coextensive with the bore diameter for registration therewith in a released condition of the latch member, an enlarged catch portion at one end of said stem encased in the handle wall adjacent the bore, and resilient means yieldably urging said catch portion into an intersecting relationship with said bore; and a cue stick shaft slidably fitted in the bore provided with a portion having an elongated through slot extending longitudinally thereof and receiving said stem portion of the latch member, said slot having a plurality of enlarged sections spaced therealong for registering and receiving said enlarged catch portion to establish a plurality of retracted shaft positions under various spring pressures, said latch having a manual trigger element to release the catch portion from an enlarged slot section and register the reduced stem portion with the bore to effect a stroking movement of said cue stick shaft.

2. The structure of claim 1 in which, said enlarged sections of the elongated slot are formed by opposed segmental portions in the side walls thereof, said catch portion is a cylindrical rod element at one end of said stem, and a second cylindrical rod element on the other end of said stem is slidably fitted in the handle wall at the opposite side of the bore to guide movement of the latch member, each of said rod elements extends outwardly beyond the opposing sides of the handle and enlarged cap members are threaded on the outer ends thereof, and said resilient means is a spring surrounding the end of the second rod element between the handle wall and cap thereof to normally urge said catch portion at the other end towards a position of engagement with an enlarged slot section.

3. The structure of claim 2 in which, the abutment of the threaded cap member on said cylindrical catch portion against the outer wall of the handle determines the extent of engagement within said slot enlargements, and the threaded connections of said cap members at each end of the latch may be adjusted to vary the triggering action for releasing the cue stick shaft.

4. The structure of claim 3, in which, the outer wall of said cue stick shaft has a longitudinally extending recessed groove and a plug is inserted in the wall of the handle having a tip end engaging said groove with a sliding fit, the ends of said groove providing front and rear end abutments engageable by said plug tip to limit overall movement of said shaft in the handle, said elongated shaft slot having enlarged sections at both the front and rear ends thereof and engagement of said plug tip at the front and rear ends of the recessed groove registering the cylindrical catch portion for automatic engagement with the enlarged sections at said front and rear ends respectively.

* * * * *